US007401481B1

(12) United States Patent
Lin

(10) Patent No.: US 7,401,481 B1
(45) Date of Patent: Jul. 22, 2008

(54) LOCK DEVICE FOR NOTEBOOK COMPUTER

(75) Inventor: Ping-Hsien Lin, Changhua Hsien (TW)

(73) Assignee: Jui Kuo Key-Making Co., Ltd., Changhua Hsien (TW)

( * ) Notice: Subject to any disclaimer, the term of this patent is extended or adjusted under 35 U.S.C. 154(b) by 0 days.

(21) Appl. No.: 11/736,677

(22) Filed: Apr. 18, 2007

(51) Int. Cl.
*E05B 73/00* (2006.01)

(52) U.S. Cl. ..... 70/14; 70/58; 70/123

(58) Field of Classification Search ..... 70/14, 70/18, 19, 49, 57, 58, 116, 123, 423, 424, 70/427–430; 292/27, 49; 248/551–553
See application file for complete search history.

(56) References Cited

U.S. PATENT DOCUMENTS

| | | | | | |
|---|---|---|---|---|---|
| 127,010 | A * | 5/1872 | Andrews | 292/27 |
| 505,299 | A * | 9/1893 | Schneider | 70/428 |
| 786,961 | A * | 4/1905 | Drakes | 292/27 |
| 1,000,946 | A * | 8/1911 | Reed | 70/64 |
| 1,991,825 | A * | 2/1935 | Strickland | 70/233 |
| 2,664,734 | A * | 1/1954 | McEneaney | 439/134 |
| 3,953,990 | A * | 5/1976 | Nagel | 70/18 |
| 4,836,707 | A * | 6/1989 | Myers | 403/322.4 |
| 5,209,530 | A * | 5/1993 | Kolloch | 292/27 |
| 5,502,989 | A * | 4/1996 | Murray et al. | 70/58 |
| 5,791,171 | A * | 8/1998 | Kelley | 70/58 |
| 5,875,657 | A * | 3/1999 | Kelley | 70/18 |
| 5,992,187 | A * | 11/1999 | Derman | 70/58 |
| 6,058,744 | A * | 5/2000 | Ling | 70/28 |
| 6,257,029 | B1 * | 7/2001 | Liao | 70/58 |
| 6,321,579 | B1 * | 11/2001 | Reyes | 70/58 |
| 6,401,502 | B1 * | 6/2002 | Yang | 70/30 |
| 6,449,992 | B1 * | 9/2002 | Yu et al. | 70/58 |
| 6,474,118 | B2 * | 11/2002 | Martinez | 70/123 |
| 6,523,373 | B1 * | 2/2003 | Su | 70/58 |
| 6,601,416 | B1 * | 8/2003 | Sanders | 70/58 |
| 6,619,081 | B1 * | 9/2003 | Yu | 70/58 |
| 6,880,373 | B2 * | 4/2005 | Ling | 70/58 |
| 6,918,272 | B1 * | 7/2005 | Sanders | 70/58 |
| 6,968,716 | B1 * | 11/2005 | Ling | 70/14 |
| 7,234,326 | B1 * | 6/2007 | Lu | 70/58 |
| 2004/0168486 | A1 * | 9/2004 | Ling | 70/58 |
| 2007/0169523 | A1 * | 7/2007 | Lu | 70/58 |

* cited by examiner

*Primary Examiner*—Lloyd A. Gall
(74) *Attorney, Agent, or Firm*—Alan Kamrath; Kamrath & Associates PA

(57) ABSTRACT

A lock device for a notebook computer includes a fixing seat, two overlapping locking members, two elastic members, a mounting ring, an extension cable and a lock unit. Thus, the notebook computer is locked onto a fixture by the lock device to prevent the notebook computer from being stolen easily. In addition, the notebook computer is locked by or unlocked from the lock device by rotation of a key, so that the lock device is operated easily and quickly, thereby facilitating a user operating the lock device.

18 Claims, 6 Drawing Sheets

LOCK DEVICE FOR NOTEBOOK COMPUTER

BACKGROUND OF THE INVENTION

1. Field of the Invention

The present relates to a lock device and, more particularly, to a lock device for a notebook computer.

2. Description of the Related Art

A notebook computer has a smaller size and lighter weight so that the notebook computer is carried and stored easily and conveniently, thereby facilitating a user operating the notebook computer in any place. However, the notebook computer is carried away easily and quickly, thereby greatly causing inconvenience to the user.

BRIEF SUMMARY OF THE INVENTION

In accordance with the present invention, there is provided a lock device, comprising a fixing seat having an inside formed with a receiving chamber and an end face formed with an elongated slot connected to the receiving chamber, two overlapping locking members pivotally mounted in the receiving chamber of the fixing seat and each having a first section formed with a locking portion protruding outwardly from the elongated slot of the fixing seat and a second section formed with a driven portion, and a lock unit including a housing mounted on the fixing seat and a lock core rotatably mounted in the housing and provided with a drive member engageable with the driven portions of the locking members to drive the locking members.

Thus, the drive member of the lock core is rotatable between a first position where the driven portions of the locking members are pressed by the drive member of the lock core, and the locking portions of the locking members intersect each other and a second position where the driven portions of the locking members are released by the drive member of the lock core, and the locking portions of the locking members overlap each other.

The primary objective of the present invention is to provide a lock device for a notebook computer, wherein the notebook computer is locked onto a fixture, such as a table or the like, by the lock device to prevent the notebook computer from being stolen easily.

Another objective of the present invention is to provide a lock device for a notebook computer, wherein the notebook computer is locked by or unlocked from the lock device by rotation of the key, so that the lock device is operated easily and quickly, thereby facilitating a user operating the lock device.

A further objective of the present invention is to provide a lock device for a notebook computer, wherein the lock device is used to lock the locking hole of the notebook computer so that the lock device will not interfere with operation of the notebook computer.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
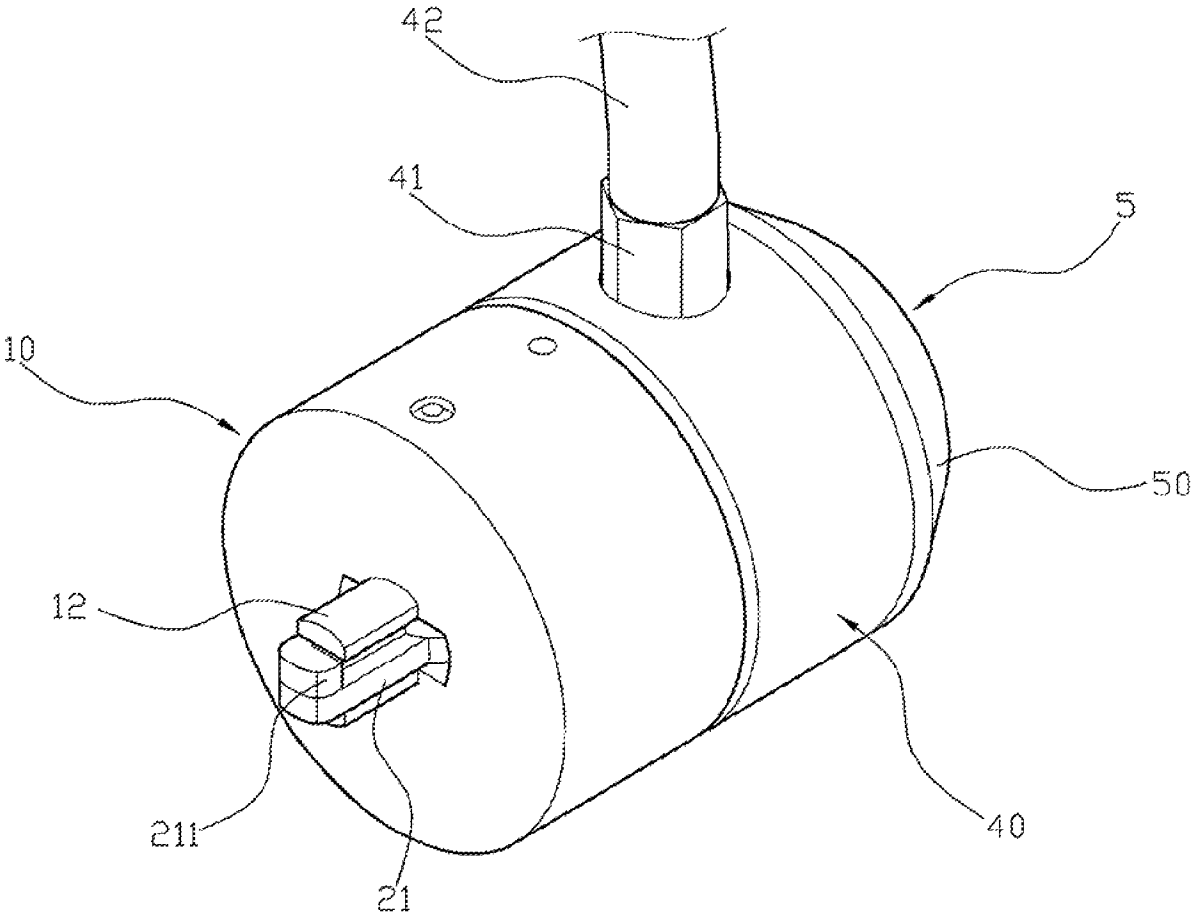
FIG. 1 is a partially perspective view of a lock device in accordance with the preferred embodiment of the present invention.

Referring to the drawings and initially to FIGS. 1-4, a lock device for a notebook computer in accordance with the preferred embodiment of the present invention comprises a fixing seat 10 having an inside formed with a receiving chamber 11 and an end face formed with an elongated slot 13 connected to the receiving chamber 11, two overlapping locking members 20 pivotally mounted in the receiving chamber 11 of the fixing seat 10 and each having a first section formed with a locking portion 21 protruding outwardly from the elongated slot 13 of the fixing seat 10 and a second section formed with a driven portion 22, and a lock unit 5 including a housing 50 mounted on the fixing seat 10 and a lock core 51 rotatably mounted in the housing 50 and provided with a drive member 52 engageable with the driven portions 22 of the locking members 20 to drive the locking members 20 so that the drive member 52 of the lock core 51 is rotatable between a first position where the driven portions 22 of the locking members 20 are pressed by the drive member 52 of the lock core 51, and the locking portions 21 of the locking members 20 intersect each other and a second position where the driven portions 22 of the locking members 20 are released by the drive member 52 of the lock core 51, and the locking portions 21 of the locking members 20 overlap each other.

The end face of the fixing seat 10 is formed with two outwardly extending protruding plugs 12, and the elongated slot 13 of the fixing seat 10 is located between the protruding plugs 12. The inside of the fixing seat 10 is formed with two opposite receiving grooves 111 located at two opposite sidewalls of the receiving chamber 11 and two receiving channels 112 each connected between the elongated slot 13 and a respective receiving groove 111. The receiving channels 112 of the fixing seat 10 are arranged in a staggered manner, and each of the receiving channels 112 of the fixing seat 10 is perpendicular to the respective receiving groove 111. Each of the receiving grooves 111 has a substantially arc-shaped cross-sectional profile and extends in an axial direction of the fixing seat 10.

Each of the locking members 20 has a substantially L-shaped cross-sectional profile and has a mediate section formed with a pivot portion 24 pivotally mounted in the receiving chamber 11 of the fixing seat 10 and formed with a pivot hole 23, and the lock device further comprises a pivot shaft 14 extended through a peripheral wall of the fixing seat 10 and the pivot hole 23 of the pivot portion 24 of each of the locking members 20 so that the pivot portion 24 of each of the locking members 20 is pivotable about the pivot shaft 14. The pivot portion 24 of each of the locking members 20 is located between the locking portion 21 and the driven portion 22.

The locking portions 21 of the locking members 20 are located between the protruding plugs 12 of the fixing seat 10. The locking portion 21 of each of the locking members 20 has a distal end formed with a locking hook 211 which protrudes outwardly from the elongated slot 13 of the fixing seat 10 and extends in a direction opposite to that of the driven portion 22, and the locking hooks 211 of the locking members 20 face each other.

The driven portions 22 of the locking members 20 are directed to opposite directions. The driven portion 22 of each of the locking members 20 is mounted in a respective receiving channel 112 of the fixing seat 10. The driven portion 22 of each of the locking members 20 is perpendicular to the locking portion 21 and has a first side formed with a protruding driven block 221 which extends in a direction opposite to that of the locking portion 21 and is directed toward the drive member 52 of the lock unit 5, and the lock device further comprises two elastic members 30 each mounted in a respective receiving groove 111 of the fixing seat 10 and each biased between the end face of the fixing seat 10 and a second side of the driven portion 22 of a respective locking member 20 to push the driven portion 22 and the driven block 221 of the respective locking member 20 toward the drive member 52 of the lock unit 5.

The lock core 51 of the lock unit 5 is operated by a key 60 to rotate the drive member 52. The drive member 52 of the lock core 51 is located between the driven blocks 221 of the locking members 20 and has a peripheral wall provided with two opposite arc-shaped press portions 520 and two opposite flattened release portions 522 located between the press portions 520.

Figure 5:
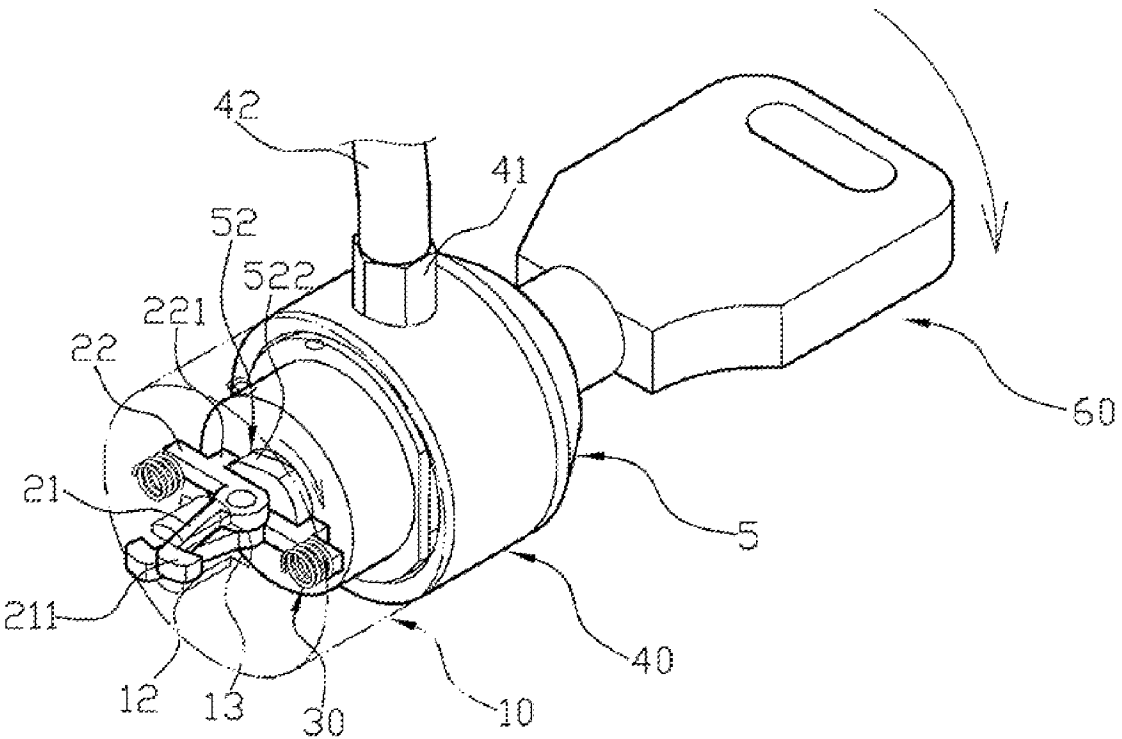
FIG. 5 is a schematic operational view of the lock device as shown in FIG. 4 in use.

Thus, when the drive member 52 of the lock core 51 is rotatable to the first position, each of the press portions 520 of the drive member 52 is movable to press the driven block 221 of the respective locking member 20 and to pivot the respective locking member 20 so that the locking portions 21 of the locking members 20 are movable toward each other to intersect each other, and the locking hooks 211 of the locking members 20 are movable toward each other until the locking hooks 211 of the locking members 20 are projected outwardly relative to each other as shown in FIG. 5.

Figure 4:
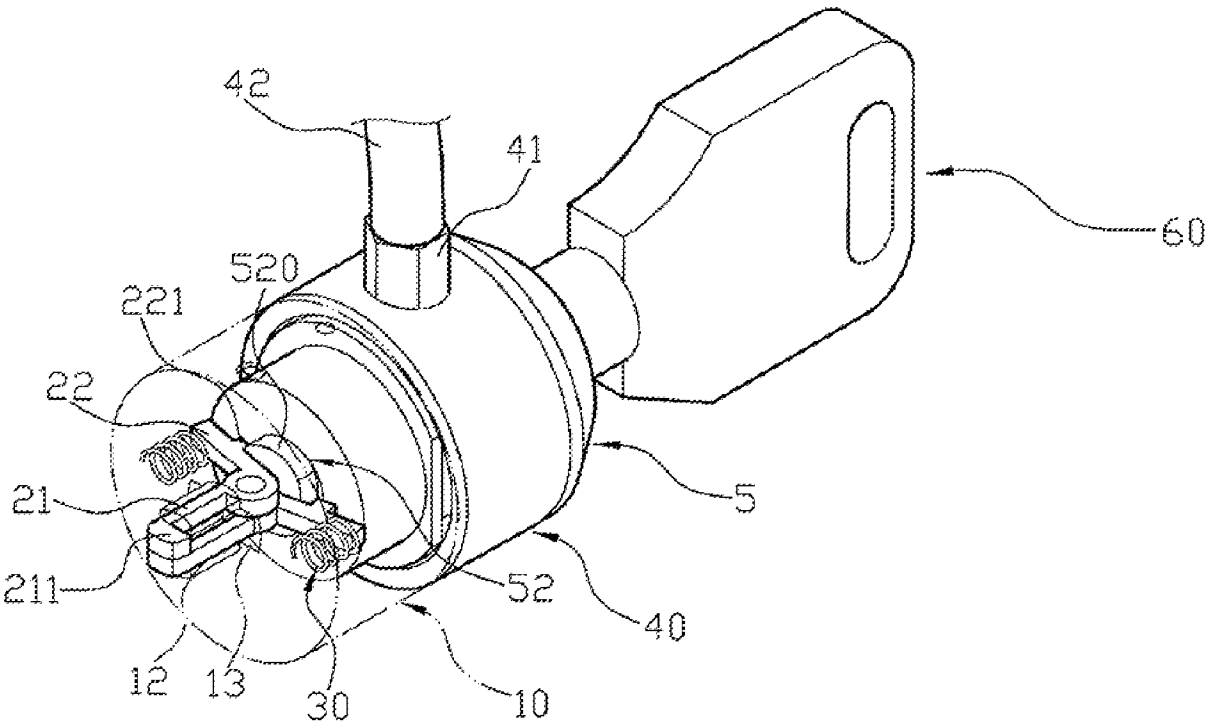
FIG. 4 is a schematic operational view of the lock device as shown in FIG. 1 in use.

On the contrary, when the drive member 52 of the lock core 51 is rotatable to the second position, each of the release portions 522 of the drive member 52 is movable to release the driven block 221 of the respective locking member 20, and the driven portion 22 of each of the locking members 20 is pushed toward the drive member 52 of the lock unit 5 by a restoring force of the respective elastic member 30 to pivot each of the locking members 20 so that the locking portions 21 of the locking members 20 are movable outwardly relative to each other, and the locking hooks 211 of the locking members 20 are movable outwardly to overlap each other as shown in FIG. 4.

The housing 50 of the lock unit 5 has an end portion formed with a protruding insert 500 inserted into the receiving chamber 11 of the fixing seat 10 and has an outer wall formed with a retaining groove 53.

Figure 6:
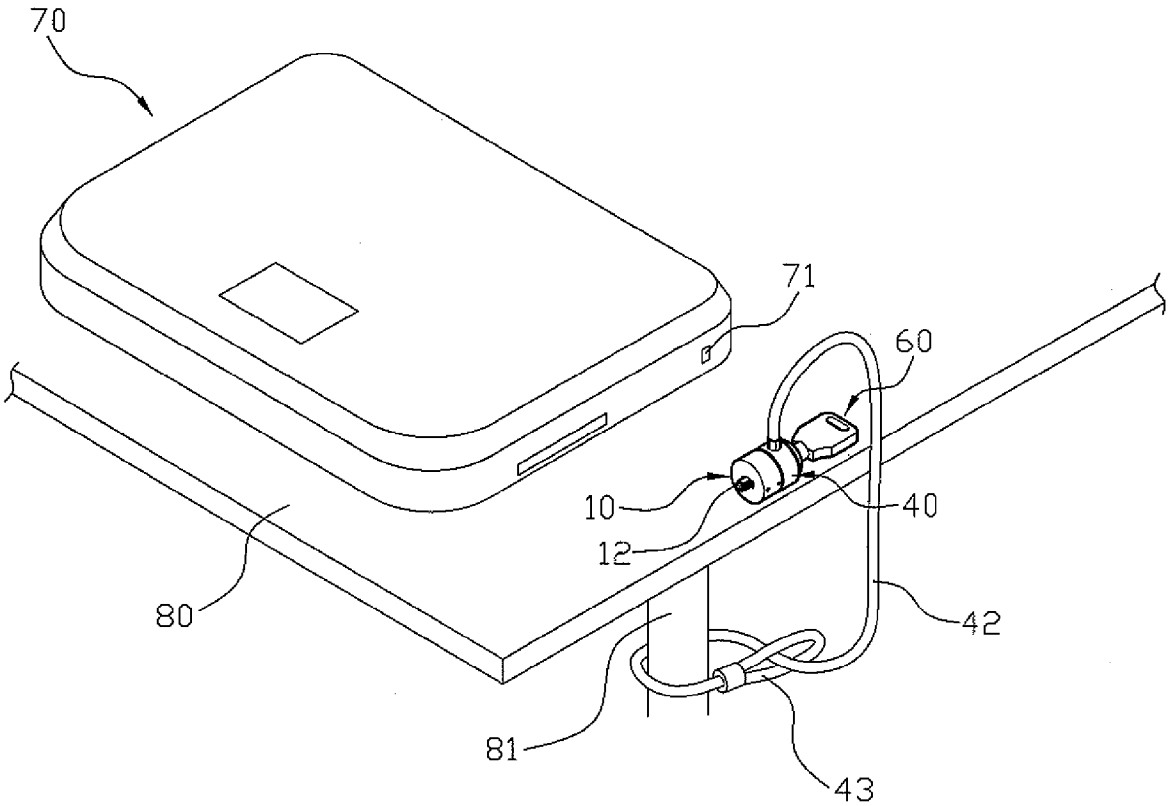
FIG. 6 is a perspective view showing the lock device for locking a notebook computer.

The lock device further comprises a mounting ring 40 mounted in the retaining groove 53 of the housing 50 and clamped between the housing 50 of the lock unit 5 and the fixing seat 10, and an extension cable 42 having a first end secured to the mounting ring 40 by a connector 41 and a second end provided with a loop 43 (see FIG. 6).

Figure 2:
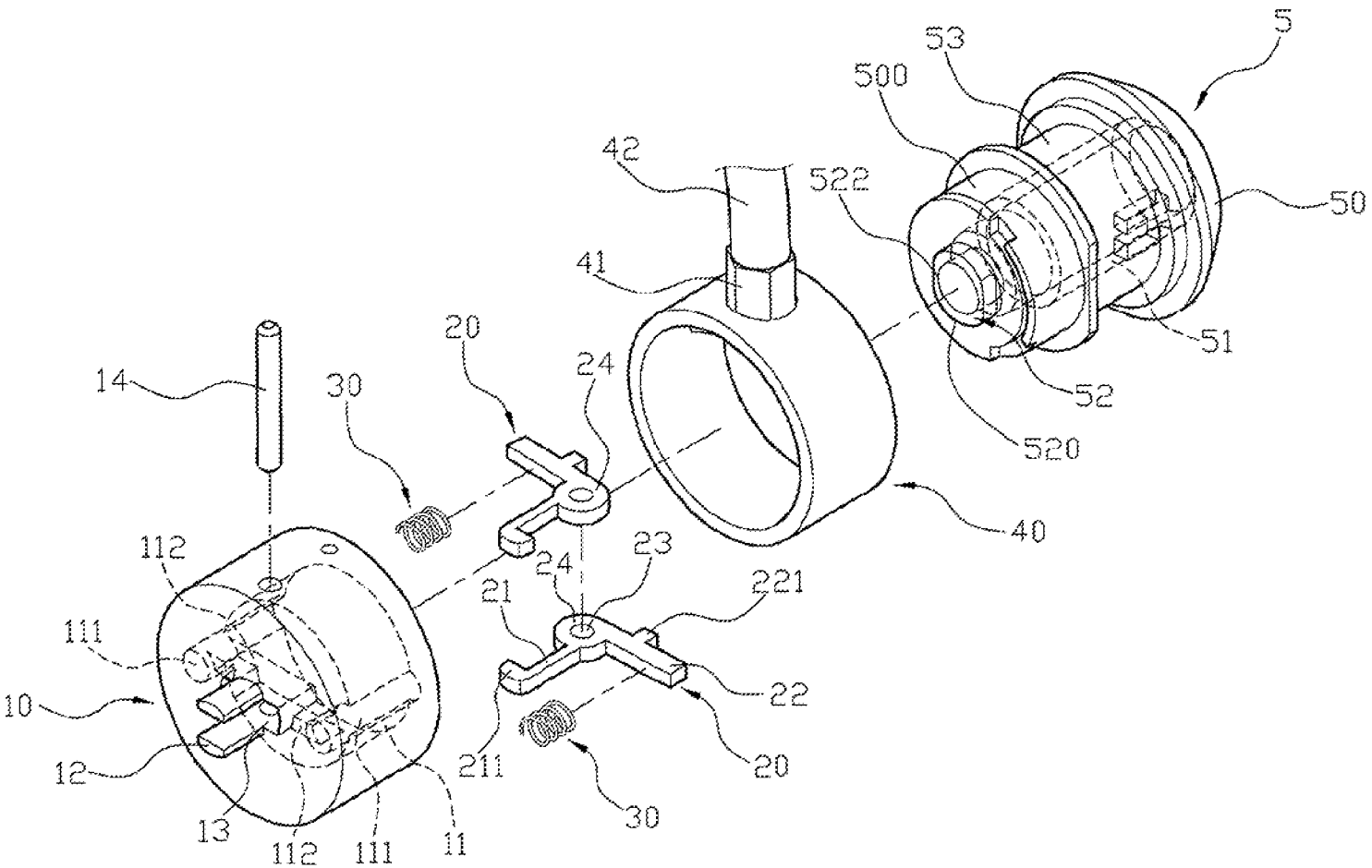
FIG. 2 is an exploded perspective view of the lock device as shown in FIG. 1.
Figure 3:
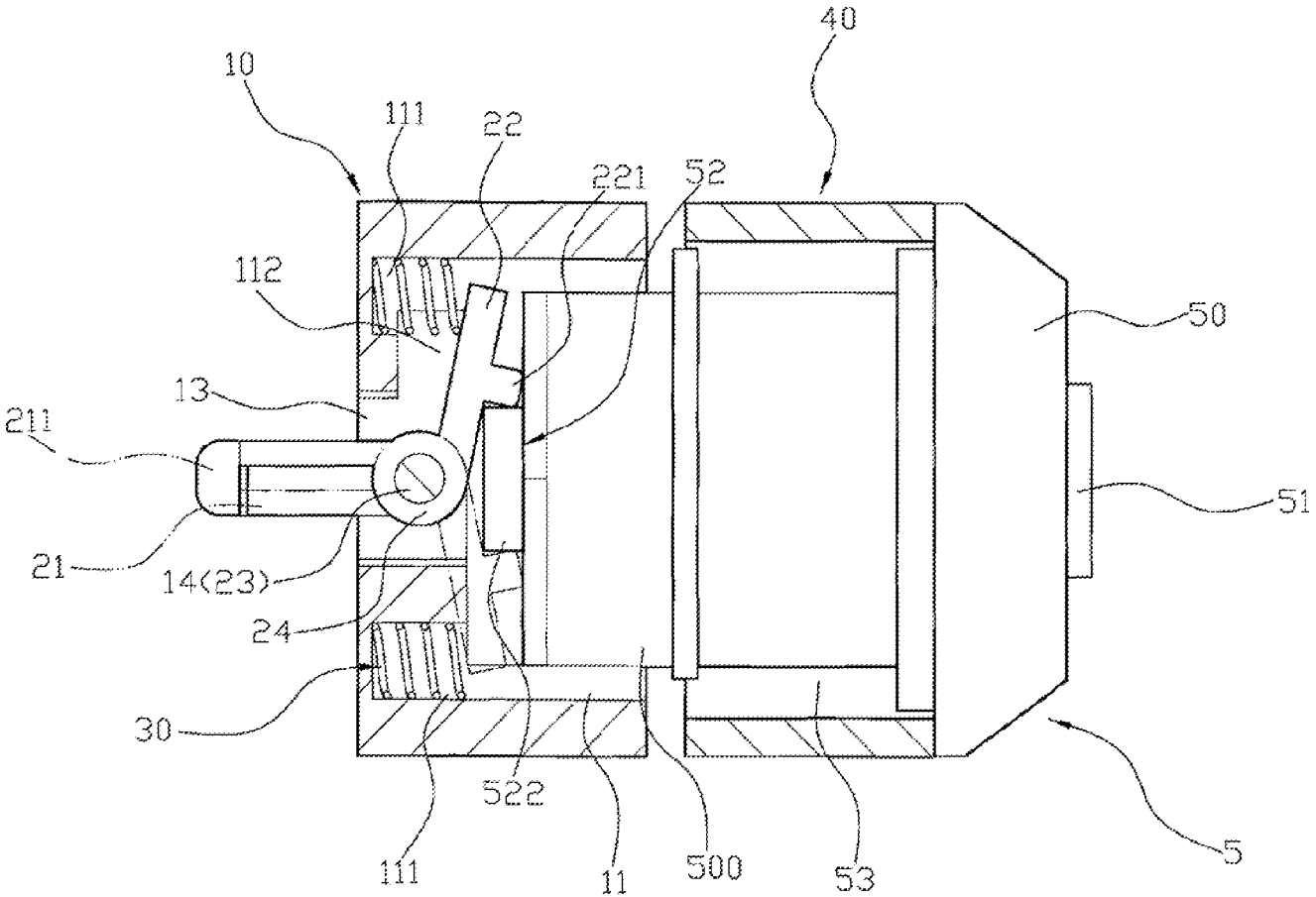
FIG. 3 is a top cross-sectional view of the lock device as shown in FIG. 1.

In operation, referring to FIGS. 4-6 with reference to FIGS. 1-3, the extension cable 42 is received through a leg 81 of a table 80 and passes through the loop 43 so that the extension cable 42 is bound onto the leg 81 of the table 80 as shown in FIG. 6. Then, the fixing seat 10 is mounted onto a notebook computer 70 placed on the table 80, and the protruding plugs 12 of the fixing seat 10 are inserted into a locking hole 71 of the notebook computer 70.

In such a manner, when the drive member 52 of the lock core 51 is rotatable to the first position as shown in FIG. 5 by rotation of the key 60, each of the press portions 520 of the drive member 52 is movable to press the driven block 221 of the respective locking member 20 and to pivot the respective locking member 20 so that the locking portions 21 of the locking members 20 are movable toward each other to intersect each other, and the locking hooks 211 of the locking members 20 are movable toward each other until the locking hooks 211 of the locking members 20 are projected outwardly relative to each other to lock two opposite sides of the locking hole 71 of the notebook computer 70. Thus, the notebook computer 70 is locked onto the table 80 by the lock device to prevent the notebook computer 70 from being stolen.

On the contrary, when the drive member 52 of the lock core 51 is rotatable to the second position as shown in FIG. 4 by rotation of the key 60, each of the release portions 522 of the drive member 52 is movable to release the driven block 221 of the respective locking member 20, and the driven portion 22 of each of the locking members 20 is pushed toward the drive member 52 of the lock unit 5 by a restoring force of the respective elastic member 30 to pivot each of the locking members 20 so that the locking portions 21 of the locking members 20 are movable outwardly relative to each other, and the locking hooks 211 of the locking members 20 are movable outwardly to overlap each other as shown in FIG. 1 to unlock the two opposite sides of the locking hole 71 of the notebook computer 70. Thus, the notebook computer 70 is unlocked from the lock device and can be carried away from the table 80.

Accordingly, the notebook computer 70 is locked onto a fixture, such as a table 80 or the like, by the lock device to prevent the notebook computer 70 from being stolen easily. In addition, the notebook computer 70 is locked by or unlocked from the lock device by rotation of the key 60, so that the lock device is operated easily and quickly, thereby facilitating a user operating the lock device. Further, the lock device is used to lock the locking hole 71 of the notebook computer 70 so that the lock device will not interfere with operation of the notebook computer 70.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lock device, comprising:

a fixing seat having an inside formed with a receiving chamber and an end face formed with an elongated slot connected to the receiving chamber;

two overlapping locking members pivotally mounted in the receiving chamber of the fixing seat and each having a first section formed with a locking portion protruding outwardly from the elongated slot of the fixing seat and a second section formed with a driven portion;

a lock unit including a housing mounted on the fixing seat and a lock core rotatably mounted in the housing and provided with a drive member engageable with the driven portions of the locking members to drive the locking members so that the drive member of the lock core is rotatable between a first position where the driven portions of the locking members are pressed by the drive member of the lock core, and the locking portions of the locking members intersect each other and a second position where the driven portions of the locking members are released by the drive member of the lock core, and the locking portions of the locking members overlap each other; wherein:

the locking portion of each of the locking members has a distal end formed with a locking hook;

the driven portion of each of the locking members has a first side formed with a protruding driven block;

the lock device further comprises two elastic members each biased between the end face of the fixing seat and a second side of the driven portion of a respective locking member to push the driven portion and the driven block of the respective locking member toward the drive member of the lock unit;

the inside of the fixing seat is formed with two opposite receiving grooves located at two opposite sidewalls of the receiving chamber and two receiving channels each connected between the elongated slot and a respective receiving groove;

the driven portion of each of the locking members is mounted in a respective receiving channel of the fixing seat;

each of the elastic members is mounted in a respective receiving groove of the fixing seat.

2. The lock device in accordance with claim 1, wherein the receiving channels of the fixing seat are arranged in a staggered manner.

3. The lock device in accordance with claim 1, wherein each of the receiving channels of the fixing seat is perpendicular to the respective receiving groove.

4. The lock device in accordance with claim 1, wherein each of the receiving grooves has a substantially arc-shaped cross-sectional profile and extends in an axial direction of the fixing seat.

5. The lock device in accordance with claim 1, wherein:

the end face of the fixing seat is formed with two outwardly extending protruding plugs;

the elongated slot of the fixing seat is located between the protruding plugs;

the locking portions of the locking members are located between the protruding plugs of the fixing seat.

6. The lock device in accordance with claim 1, wherein:

each of the locking members has a mediate section formed with a pivot portion pivotally mounted in the receiving chamber of the fixing seat and formed with a pivot hole;

the lock device further comprises a pivot shaft extended through a peripheral wall of the fixing seat and the pivot hole of the pivot portion of each of the locking members so that the pivot portion of each of the locking members is pivotable about the pivot shaft.

7. The lock device in accordance with claim 6, wherein the pivot portion of each of the locking members is located between the locking portion and the driven portion.

8. The lock device in accordance with claim 1, wherein the driven block of each of the locking members extends in a direction opposite to that of the locking portion.

9. The lock device in accordance with claim 1, wherein the driven block of each of the locking members is directed toward the drive member of the lock unit.

10. The lock device in accordance with claim 1, wherein the drive member of the lock core is located between the driven blocks of the locking members and has a peripheral wall provided with two opposite arc-shaped press portions and two opposite flattened release portions located between the press portions.

11. The lock device in accordance with claim 10, wherein:

when the drive member of the lock core is rotatable to the first position, each of the press portions of the drive member is movable to press the driven block of the respective locking member and to pivot the respective locking member so that the locking portions of the locking members are movable toward each other to intersect each other, and the locking hooks of the locking members are movable toward each other until the locking hooks of the locking members are projected outwardly relative to each other;

when the drive member of the lock core is rotatable to the second position, each of the release portions of the drive member is movable to release the driven block of the respective locking member, and the driven portion of each of the locking members is pushed toward the drive member of the lock unit by a restoring force of the respective elastic member to pivot each of the locking members so that the locking portions of the locking members are movable outwardly relative to each other, and the locking hooks of the locking members are movable outwardly to overlap each other.

12. The lock device in accordance with claim 1, wherein:

the housing of the lock unit has an outer wall formed with a retaining groove;

the lock device further comprises:

a mounting ring mounted in the retaining groove of the housing and clamped between the housing of the lock unit and the fixing seat;

an extension cable having a first end secured to the mounting ring by a connector and a second end provided with a loop.

13. The lock device in accordance with claim 1, wherein the housing of the lock unit has an end portion formed with a protruding insert inserted into the receiving chamber of the fixing seat.

14. The lock device in accordance with claim 1, wherein the driven portion of each of the locking members is perpendicular to the locking portion.

15. The lock device in accordance with claim 1, wherein each of the locking members has a substantially L-shaped cross-sectional profile.

16. The lock device in accordance with claim 1, wherein the locking hook of the locking portion of each of the locking members protrudes outwardly from the elongated slot of the fixing seat and extends in a direction opposite to that of the driven portion.

17. The lock device in accordance with claim 1, wherein the locking hooks of the locking members face each other.

18. The lock device in accordance with claim 1, wherein the driven portions of the locking members are directed to opposite directions.

* * * * *